US006105393A

United States Patent [19]

Takessian

[11] Patent Number: 6,105,393

[45] Date of Patent: Aug. 22, 2000

[54] GEM STONE SETTING FOR ARTICLES OF JEWELRY

[76] Inventor: Karabet Takessian, 41721 Hanford, Canton, Mich. 48187

[21] Appl. No.: 09/394,385

[22] Filed: Sep. 10, 1999

[51] Int. Cl.[7] ..... A44C 17/02

[52] U.S. Cl. ..... 63/26; 63/15; 63/27

[58] Field of Search ..... 63/15, 26, 27

[56] References Cited

U.S. PATENT DOCUMENTS

| | | | |
|---|---|---|---|
| D. 332,235 | 1/1993 | Bonchek | D11/35 |
| 1,293,028 | 2/1919 | Cambell | 63/26 |
| 1,548,645 | 8/1925 | Akeson | 63/15 |
| 1,855,066 | 4/1932 | Peters | 63/15 |
| 1,941,782 | 1/1934 | Bager | 63/27 |
| 2,141,363 | 12/1938 | Rigollet | 63/26 X |
| 2,606,418 | 8/1952 | Fluckiger | 63/26 X |
| 2,756,572 | 7/1956 | Yeager et al. | 63/26 |
| 3,509,734 | 5/1970 | Lederer | 63/15 |
| 5,090,217 | 2/1992 | Beber et al. | 63/27 |
| 5,285,659 | 2/1994 | Bardisbanyan | 63/26 |
| 5,664,440 | 9/1997 | Roemer | 63/15 |
| 5,765,398 | 6/1998 | Bardisbanyan | 63/26 |
| 5,868,008 | 2/1999 | Yamaura et al. | 63/15 |

FOREIGN PATENT DOCUMENTS

| | | | |
|---|---|---|---|
| 2367445 | 6/1978 | France | 63/27 |
| 826492 | 1/1960 | United Kingdom | 63/26 |

*Primary Examiner*—Terry Lee Melius
*Assistant Examiner*—Andrea Chop
*Attorney, Agent, or Firm*—Andrew E. Pierce

[57] ABSTRACT

An article of jewelry which includes a facet-cut gem stone having a girdle and a culet. The gem stone is secured by novel connecting members having a bearing surface adapted to hold the gem stone at the vicinity of the gem stone girdle in conjunction with the insertion of the culet of the gem stone into a recess in the article of jewelry.

6 Claims, 1 Drawing Sheet

GEM STONE SETTING FOR ARTICLES OF JEWELRY

TECHNICAL FIELD

This invention relates to a novel article of jewelry and method of making.

BACKGROUND ART

The present invention relates to a novel combination of a gem stone, an article of jewelry and connecting members adapted to secure the gem stone to the article of jewelry. A method disclosed for setting precious stones in jewelry rings or the like is especially adapted to setting stones in round structural elements such as rings, bracelets, and earrings, as well as pendants. Stone setting is a highly-skilled art. Skilled workers are required to perform such setting operations. Since labor is a high cost part of the manufacture of jewelry, various approaches have been employed in the prior art to simplify the assembly of jewelry, especially fine jewelry employing precious as well as non-precious stones.

In the prior art, gem stones such as diamonds have been cut and polished to form gems and then set in rings, earrings, and other objects to form jewelry. One diamond cut which is currently popular is the round, facet-cut, or brilliant-cut shape in which the gem stone is divided into an upper portion, known as the crown, a lower portion referred to as the pavilion. The circumference of the gem where the crown meets the pavilion is termed the girdle. In addition, the top surface of the gem is known as the table and the lower, pointed section of the gem is known as the culet.

In the prior art, one of the most popular types of gem stone settings is the prong type setting. The advantage of the prong setting is that the gem is allowed to be exposed to more light than in other types of settings, such as channel or bezel settings. Utilizing the prong type setting, the jeweler cuts notches near the top of each of the multiple prongs which are attached at the opposite ends to an article of jewelry. The notches conform to the shape of the crown and pavilion immediately adjacent to the girdle of the gem stone. The jeweler then encloses the gem stone within the multiple prongs with the gem stone being held at the girdle in the notches. The portions of the prongs above the notches are then bent over the crown of the gem stone with jewelers pliers. This type of setting can only be used by a skilled jeweler.

In U.S. Pat. No. 5,671,613 to Hoover et al., a gem stone setting is disclosed including a base having multiple prongs extending therefrom. The method of Hoover et al. is adapted for gem stone setting by a jeweler as well as an unskilled layman.

In each of U.S. Pat. No. 5,285,659 and U.S. Pat. No. 5,765,398 to Bardisbanyan, a method and an apparatus for setting stones in jewelry is disclosed. In '659, a housing is formed by a pair of opposed channel-shaped legs which can be squeezed together to encircle and hold the girdle portion of the gem stone. At one end of the mounting, there is provided a post which is securable to the free end of the opposed leg of the mounting by welding. In '398, round gem stones are placed in large apertures in an article of jewelry such as a ring, the size of the aperture being slightly smaller than the circumference of the gem stone at the girdle so that the gem stone nests into the aperture. The gem stones are secured by pin shaped connecting members which bear at the head of the pin on a portion of the crown of the gem stone and are secured at the opposite end to the ring by soldering.

In U.S. Pat. No. 5,664,440 to Roemer, there is disclosed a composite ring having a setting which combines a colored inner gem stone and a diamond outer gem stone. The color generated by light passing through the inner stone is visible when the diamond is viewed. Prong-type gem stone settings are utilized.

DESCRIPTION OF THE PREFERRED EMBODIMENTS

Figure 1:
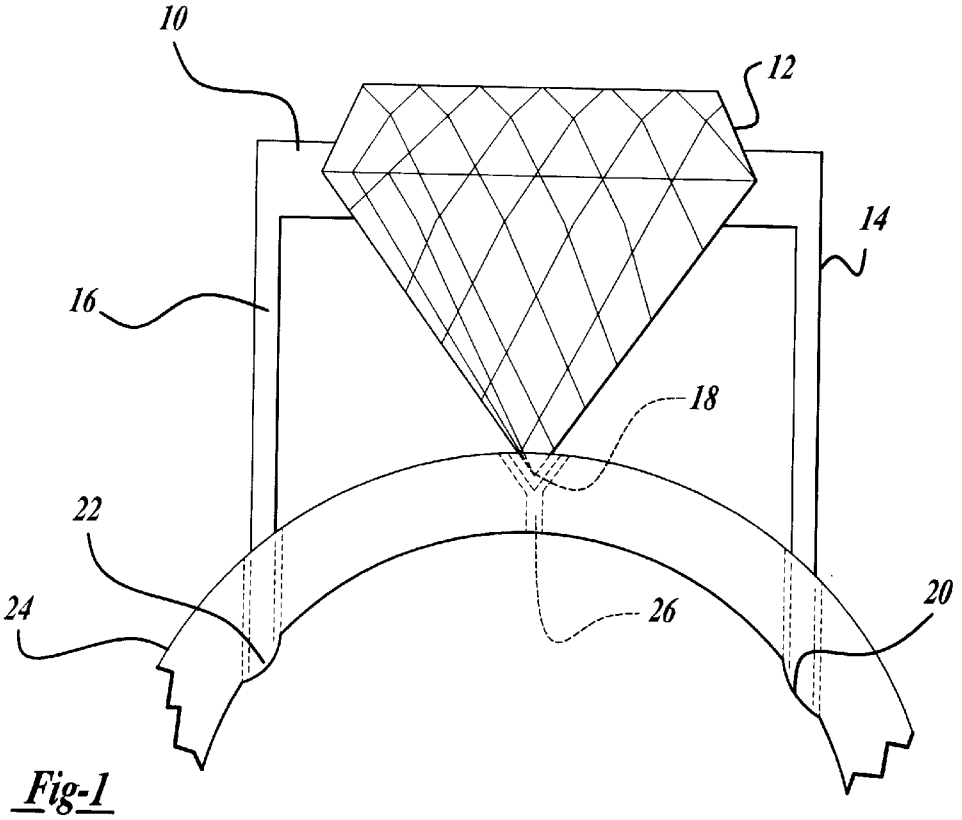
FIG. 1 is a perspective view, partly diagrammatic, of a setting in accordance with one embodiment of the invention.

In FIG. 1 there is illustrated an embodiment of a finger ring according to the present invention in a perspective, partly diagrammatic view in which a gem stone 12, preferably round or oval, is secured to a ring 24 by connecting members such as at least two supporting posts 14 and 16. Each post 14 and 16 can have a cylindrical, oval, triangular, rectangular or other cross section. More appropriately, such supporting posts are replaced by a decorative support structure used with the proviso that a holding portion of the structure is firmly attached to the surface of an article of jewelry such as a ring by welding or other means. The bearing structure 10 can bear only or be conforming only to the slope of the gem stone crown adjacent to the girdle or can be characterized as bezel set, prong set, or channel set so as to straddle the gem stone adjacent to the girdle. At the opposite end of the supporting posts 14 and 16, the posts are adapted to fit within apertures passing from the outer surface to the opposite inner surface of the jewelry article so as to provide a suitable area on the inner surface opposite the outer surface to which the gem stone is attached at which the post can be secured by welding at locations 20 and 22 on ring 24. In addition to securing the gem stone as described above, the culet of the gem stone is positioned in a recess 18 in the article of jewelry adapted to receive no more than a portion of the culet which is sufficient to stabilize the attachment of the gem stone to the article of jewelry. The recess 18 is in communication with the opposite surface of the ring by passage 26.

Figure 2:
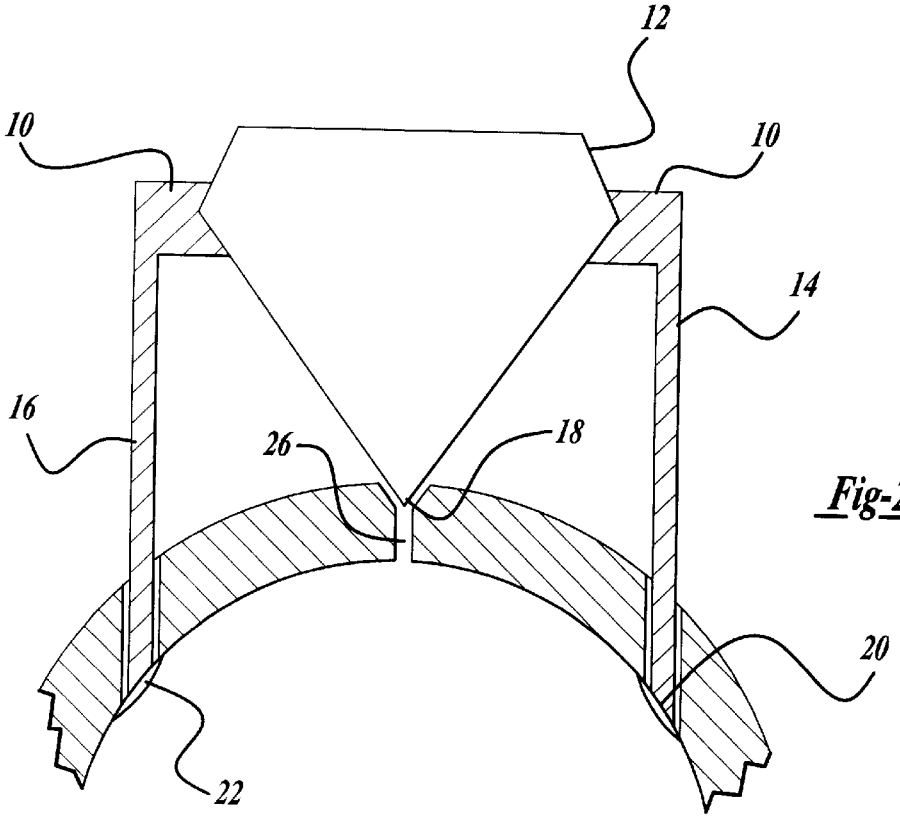
FIG. 2 is a cross-sectional view on line 2—2 shown in FIG. 1.

In FIG. 2, there is illustrated in a cross sectional view, taken at the same plane as FIG. 1, the attachment of a gem stone to an article of jewelry utilizing a bezel set bearing surface 10. As can be readily seen by viewing the figures, the welding of the posts to the article of jewelry at positions 20 and 22 can be accomplished without subjecting the gem stone to a significant amount of heat during assembly thus avoiding potential damage to the gem stone and, yet, providing a structural assembly which is rigid and secure.

In accordance with the principles of this invention, precious and non-precious stones can be set in round jewelry such as rings, earrings, and the like or in lockets and pendants by providing apertures in the surface of the jewelry into which a stone or stones are to be set. The stone or stones are held partly by connecting members having bearing surfaces encircling only the portion of the gem stone above the girdle thereof or by an encircling bearing surface conforming to the slope of the crown and the pavilion adjacent to the girdle. The encircling bearing surfaces are supported by at least two supporting means such as posts which are in turn supported on the surface of the ring. Apertures are provided on the surface of the jewelry onto which the stones are to be placed in order to attach posts which support the bearing surfaces. The posts are secured by welding or cold soldering. Advantageously, the welding or soldering operation can be conducted on the inner surface of the ring, thus ensuring that the gem stone, mounted on the outer surface, is not damaged by the heat involved in welding. Instead of simple posts as supporting means, decorative supporting means can be utilized alternatively to replace such posts. An end portion of the decorative supporting means used alternatively to the above posts must be adapted to placement within apertures in the surface of the jewelry onto which the stone or stones are placed in order to facilitate the welding or cold soldering of such supporting means.

The stone or stones are also held in place on the article of jewelry by placement of the culet into a recess, shaped to receive the culet, on the article of jewelry. In the case of a finger ring, this recess is in communication with the opposite surface of the ring in order that the culet will not be subject to damaging pressure during subsequent manufacturing operations. As indicated above, different structural forms and shapes can be used instead of the connecting member posts shown in the drawings as supporting means for the bearing surfaces encircling the gem stone. Various stone shapes can be utilized in addition to the preferred round, facet-cut, or brilliant-cut gem stone which is one of the most popular types of gem stones. These other stone shapes include oval and rectangular shaped stones. Various other gem stones can be substituted for the preferred diamond depending upon the tint or hue one wishes to obtain. Suitable stones include tanzanite, topaz, tourmaline, lapis, opal, amethyst, etc.

It is a feature of the method of the present invention that gem stones can be securely mounted on articles of jewelry by unskilled persons thus reducing the high cost of setting a gem stone by a skilled jeweler. In the method of the invention, a welding process is used in which the welding of the components is accomplished away from the immediate proximity of the gem stone thus avoiding injury of the gem stone by exposure to high heat conditions. Should additional heat protection be necessary to avoid damage to the gem stone, a cold soldering or fusion welding process can be employed to attach the connecting member supporting posts to the surface of the jewelry article through which the supporting posts are placed. By avoiding the use of significant heat immediately adjacent to the gem stone in the assembly and mounting of gem stones, damage to the gem stone is avoided while the structural assembly is rigidly formed by welding.

In accordance with the principles of this invention, a precious or semi-precious stone or diamond such as an oval or round shaped stone can be mounted utilizing connecting members having cast or extruded metal bearing surfaces, preferably, formed so as to conform only to that portion of the gem stone immediately above the girdle thereof. Connecting members having bearing structures, the surfaces of which have a shape conforming to the slope of the gem stone crown and pavilion immediately adjacent to the girdle, can also be used. Connecting members can have various cross sectional shapes including oval, circular, triangular, and rectangular. Said latter bearing structure surfaces can be channel shaped or bezel shaped bearing surfaces conforming to the gem stone slope immediately above and immediately below the girdle of the gem stone. The bearing surface can be cast or formed to conform to the slope of the surface of the gem stone crown which is immediately above the girdle of the gem stone or the bearing surface can be formed of a nonconforming, for instance, circular cross section bearing surface. Connecting member posts or legs which are attached to and extend downwardly toward the article of jewelry from the bearing surface encircling the gem stone can be of any cross section. Apertures in the article of jewelry are located adjacent to the central recess shaped to receive the culet. After each post has been inserted through the aperture in the article of jewelry, the post is secured to the article of jewelry by welding.

It is an object of the present invention to address one of the great disadvantages of the prior art gem stone settings in that the services of a skilled jeweler are usually needed in order to set a gem stone in an article of jewelry. It is possible for an unskilled layman to easily and quickly set a cut gem stone such as a diamond utilizing the disclosed gem stone setting in accordance with the method of setting disclosed herein. Accordingly, it is an object of the invention to provide a gem stone setting which maintains a gem stone at a desired position in the setting on an article of jewelry utilizing methods of setting which can be performed even by an unskilled layman.

In order to fulfill the objects of the invention, there is provided a novel bearing surface attached to connecting member supporting means such as posts or suitable decorative means wherein both the culet of the gem stone and the posts are secured to an article of jewelry. The gem stone is inserted into a recess in the article of jewelry merely to an extent necessary to provide firm support to the culet of the gem stone while the posts holding the gem stone, attached to the outer bearing surface of the structure, are inserted into apertures having a length sufficient to penetrate to the opposite surface of the article of jewelry whereupon these posts are welded to the article of jewelry.

The method of assembly is as follows: A gem stone, preferably of round or oval shape, is selected. Connecting members comprising a bearing means are positioned so as to encircle the gem stone on both sides of the girdle or only on the upper surface of the gem stone immediately above the girdle. Extending downwardly toward the article of jewelry from the gem stone are connecting members such as posts or decorative supporting structures attached securely to the surface of the article of jewelry by the following procedure. The gem stone with the bearing structure in place is placed over the article of jewelry and the culet of the gem stone is inserted into a central recess shaped to receive said culet. The recess in the article of jewelry has a depth sufficient to secure the gem stone in place. In the case of a finger ring, this recess is in communication with the opposite surface of the ring in order that the culet will not be subject to damaging pressure during subsequent manufacturing operations. The posts extending downwardly from the bearing structure are inserted into apertures located adjacent to the central aperture and pass through the article of jewelry from the gem stone side to the opposite side whereupon the assembly is placed into a clamping mechanism which rigidly maintains the gem stone and the posts in contact with the article of jewelry. The posts are then welded to the article of jewelry. Thus, there is provided a simple and cost-efficient method of assembly utilizing a bearing surface to which supporting posts are attached. The mounted gem stone is rigidly attached to the article of jewelry both by the insertion of a portion of the culet into an aperture in the article of jewelry and by the welding of supporting posts extending from the bearing surface.

The invention has been described with reference to the setting of an oval or circular shaped gem stone. Other shapes or forms for the gem stone can be employed as well as other shapes or forms for the supporting post members which connect the bearing structure to the article of jewelry. In addition, the invention has been described with reference to jewelry rings but other jewelry structures such as bracelets, earrings, or the like as well as lockets and pendants can employ the gem setting and method of gem setting described in the present invention. The described method of assembly of precious and non-precious stones to articles of jewelry in accordance with the method of the invention can be employed both if the article of jewelry is round as in finger rings or substantially flat and not round as found in pendants and lockets or the like. Inserting the culet of the gem stone into a recess of the article of jewelry is sufficient to stabilize the gem stone in conjunction with use of connecting means consisting of only two posts as described.

Since the invention can be embodied in other forms than shown herein without departing from the spirit and scope of the invention, it is intended that the scope of the invention will be defined by the appended claims rather than by any specific embodiment of the invention disclosed above.

What is claimed is:

1. A combination comprising a facet-cut gem stone, an article of jewelry, and at least two connecting members adapted to secure said gem stone to said article of jewelry, A. said gem stone comprising a table, a crown, a girdle, a pavilion, and a culet, B. said article of jewelry having surfaces consisting of an outer surface to which said gem stone is secured and an inner surface, said outer surface comprising a recess in communication with said inner surface of such article of jewelry and in contact with no more than a portion of said culet which is sufficient to stabilize the attachment of said stone to said article of jewelry and, positioned adjacent thereto, apertures each of which receive a portion of one of said connecting members, C. said table oriented in a direction generally parallel to said outer surface of said article of jewelry, D. said connecting members each bearing upon a portion of at least one of said crown or said crown and said pavilion and a holding portion opposite thereto secured to said article of jewelry at said apertures.

2. The combination of claim 1 wherein said article of jewelry is a ring and said recess shaped to receive said culet is in communication with an opposite surface of said ring.

3. The combination of claim 2 wherein said connecting members bear upon portions of said crown and pavilion which are adjacent to said girdle.

4. The combination of claim 2 wherein said connecting members conform only to a portion of said crown adjacent to said girdle.

5. The combination of claim 2 wherein said connecting members have a cross section selected from cross sections of the group consisting of oval, circular, triangular, and rectangular.

6. The combination of claim 1 wherein said article of jewelry is a pendant.

* * * * *